US006080094A

United States Patent [19]

Dahlquist

[11] Patent Number: 6,080,094

[45] Date of Patent: Jun. 27, 2000

[54] STEPPER ADVERTISING DEVICE AND METHOD

[75] Inventor: Ake L. Dahlquist, Dixon, Ill.

[73] Assignee: Sleepeck Printing Company, Dixon, Ill.

[21] Appl. No.: 09/136,533

[22] Filed: Aug. 19, 1998

Related U.S. Application Data

[62] Division of application No. 08/769,029, Dec. 18, 1996.

[51] Int. Cl.[7] ..... B65B 11/48

[52] U.S. Cl. ..... 493/216; 493/10; 229/92.3

[58] Field of Search ..... 493/10, 216; 229/73, 229/92.3, 92.8

[56] References Cited

U.S. PATENT DOCUMENTS

| | | | |
|---|---|---|---|
| 1,076,450 | 10/1913 | Rindsberg . | |
| 1,362,779 | 12/1920 | Cernicky . | |
| 2,062,776 | 12/1936 | Berkowitz . | |
| 3,073,509 | 1/1963 | Schuessler | 229/73 |
| 3,126,148 | 3/1964 | Hanson . | |
| 4,044,942 | 8/1977 | Sherwood . | |
| 4,660,856 | 4/1987 | Shacklett, Jr. . | |
| 4,826,475 | 5/1989 | Eweryd | 493/10 |
| 4,972,655 | 11/1990 | Ogawa | 493/216 X |
| 5,467,917 | 11/1995 | Potter . | |
| 5,507,131 | 4/1996 | Schluger | 493/216 X |

*Primary Examiner*—Timothy V. Eley
*Assistant Examiner*—Anthony Ojini
*Attorney, Agent, or Firm*—Ryndak & Lyerla

[57] ABSTRACT

A printed advertising device is formed by folding a sheet to form a wrapper. The wrapper may enclose a variety of enclosures such as product samples or order forms. The enclosures are retained within the advertising device by a novel arrangement that is required to be opened in steps requiring involvement and participation by a user and building anticipation. The advertising device is created by several manipulations of a web, such as folding and applying adhesive using web printing equipment. The advertising device may be a mailing device, a magazine insert or a stand-alone circular. insert or a stand-along circular.

36 Claims, 5 Drawing Sheets

STEPPER ADVERTISING DEVICE AND METHOD

This is a divisional of U.S. patent application Ser. No. 08/769,029, filed Dec. 18, 1996.

FIELD OF THE INVENTION

This invention relates to an advertising device and method for printed matter, and in particular, to an advertising device and method that includes various promotional message areas formed as a part of the device that become exposed in steps requiring involvement and participation from a user.

BACKGROUND OF THE INVENTION

The consuming public is inundated with print advertisement, such as mail, newspaper ads and magazine ads. This places advertisers in competition with each other to gain the attention of consumers. Prior attempts to gain the attention of consumers have included catchy slogans, startling artwork, novelty items, contests, prizes, redeemable coupons and in some cases even the inclusion of token sums of money. Though these traditional attempts at gaining the attention of consumers have been somewhat successful, a continuous need exists for a structure that gains the attention of consumers, to gain more sales per advertising dollar.

Additionally, attempts to gain the attention of consumers must be capable of reaching numerous consumers in an efficient manner. Thus, the most efficient attention grabbing advertisement should be easily mass manufactured and also cost effective.

SUMMARY OF THE INVENTION

Accordingly, one aspect of the present invention provides an advertising device and method with novel structural features for gaining the attention of consumers through their interactive involvement with the device.

In accordance with another aspect of the present invention, an advertising device and method are provided that may be manufactured using commercially available printing press and in-line finishing equipment.

In accordance with the present invention, an advertising device or vehicle, which may be in the form of a mailing device, a magazine insert or a stand-alone circular, is provided. The advertising device may be mass manufactured using available graphic arts web press equipment. The advertising device includes a novel structure requiring completion of a number of steps by a person opening the device, attracting the attention of the person by requiring involvement and participation and building anticipation.

In one aspect of the present invention, an advertising device in the form of a mailing device is formed from a first sheet having a front panel, back panel, interior flap, and exterior flap. The front panel adjoins the back panel at a first fold; the front panel adjoins the exterior flap at a second fold; and the back panel adjoins the interior flap at a third fold. The front panel may serve as the front of the mailing device wherein the address is displayed. The second fold and third fold may be aligned such that the exterior flap overlays the interior flap and the combination of the exterior and interior flap also overlays a portion of the back panel. In the closed configuration, the exterior and interior flaps and the back panel form the back of the mailing device. A portion of the outer surface of the interior flap is releasably secured to the back panel and a portion of the inner surface of the exterior flap is releasably secured to the interior flap.

A first promotional message is displayed on the surface of the interior flap that is adjacent the back panel and is accessible by releasing the combination of the exterior and interior flaps from the back panel. A second promotional message is available on the surface of the exterior flap adjacent the interior flap and optionally, on the surface of the interior flap adjacent the exterior flap. The second promotional message is available after releasing the seal between the interior flap and the exterior flap. Once this seal is broken, the interior of the mailing device, which may include additional promotional messages, enclosures, return envelopes, response cards, order forms, or pledge cards, is available. By the novel arrangement of the flaps and panels of the mailing device, promotional message areas and other promotional materials are made available to the user in steps.

In another aspect of the present invention, a method is provided for forming an advertising device. The method may require plow folding stations, multiple glue application systems, a die cutter, a rotary cutter and a delivery system. In accordance with the method, a first ribbon having an inner and outer surface is conveyed along a first path. Then a first adhesive is applied along a first portion of the inner surface of the first ribbon near a first edge of the ribbon. The ribbon is then folded such that the first adhesive releasably secures the first portion of the inner surface of the ribbon near a second edge of the first ribbon opposite the first edge. A second adhesive is then applied along a second portion of the outer surface of the first ribbon in an area near the first edge. Preferably, the second adhesive is applied further from the first edge than the first adhesive. By folding the first ribbon such that the second adhesive releasably secures the outer surface of the first ribbon to a third portion of the outer surface of the first ribbon, the device is formed. Preferably, a second ribbon conveyed along a second path is folded into an enclosure and aligned with the first ribbon prior to folding the first ribbon to form the device.

BRIEF DESCRIPTION OF THE DRAWINGS

in FIG. 1 in a partially open configuration;

DETAILED DESCRIPTION

Figure 1:
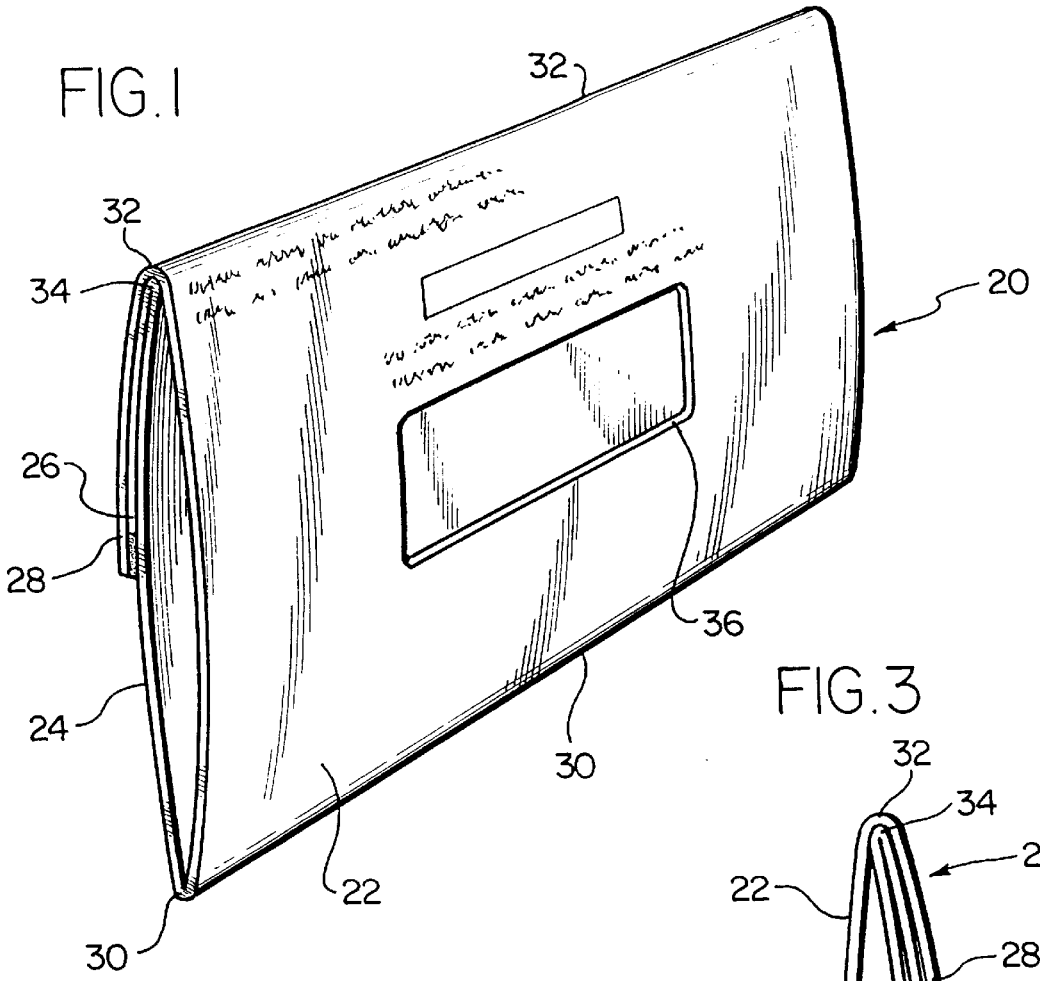
FIG. 1 is a perspective view of an advertising device in accordance with the present invention in the form of a mailing device.
Figure 2:
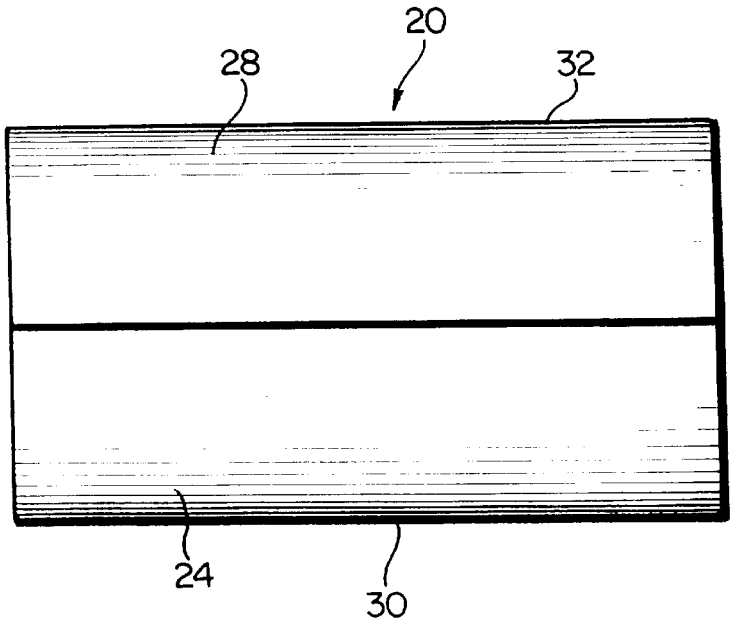
FIG. 2 is a back view of the mailing device shown in FIG. 1.

Referring to the Figures generally where like numerals refer to like parts, and in particular, to FIGS. 1 and 2, there is illustrated an advertising device in accordance with the present invention in the form of a stand-alone mailing device 20. Mailing device 20 is one sheet formed into a front panel 22, a back panel 24, an interior flap 26, and an exterior flap 28. Front panel 22 is the address side of mailing device 20. A first fold 30 runs horizontally across the bottom of mailing device 20 defining a point of intersection between front panel 22 and adjoining back panel 24. A second fold 32 runs horizontally across the top of mailing device 20 being substantially parallel to first fold 30. Second fold 32 separates and defines a point of intersection between front panel 22 and adjoining exterior flap 28. A third fold 34, which is substantially aligned with second fold 32, separates and defines a point of intersection between back panel 24 and interior flap 26. Exterior flap 28 overlays interior flap 26, and the combination of exterior flap 28 and interior flap 26 overlays a portion of back panel 24 forming the back of mailing device 20. As is traditional with mailing devices, mailing device 20 has sendee address portion 36 centrally located within front panel 22. Sendee address portion 36 is shown in the form of a die-cut opening or window for exposing a card or enclosure (not shown) containing the sendee's address. If no card or enclosure is required, the sendee's address may be applied directly to front panel 22 in sendee address portion 36, eliminating the need for a window.

Figure 3:
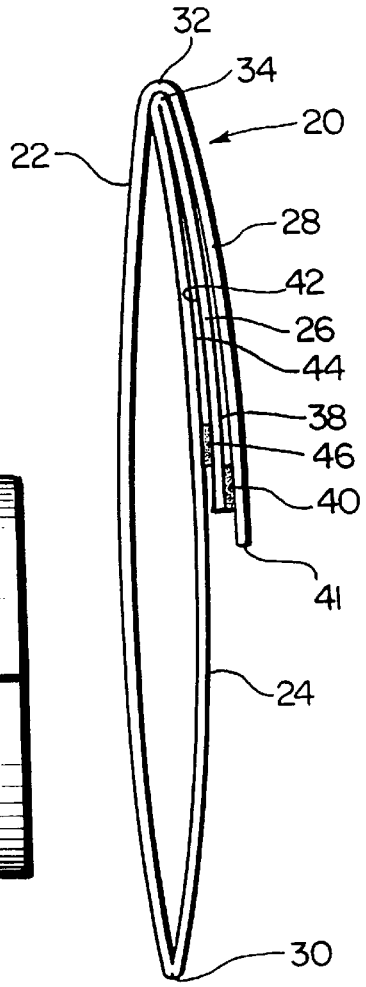
FIG. 3 is a side view of the mailing device shown in FIG. 1.

FIG. 3 is a side view of mailing device 20, showing exterior flap 28 adhesively attached to an inner surface 38 of interior flap 26. This attachment is preferably made by fugitive glue 40 near an edge 41 of exterior flap 28. Interior flap 26 is preferably attached at its outer surface 42 to outer surface 44 of back panel 24 by fugitive glue 46. Preferably, fugitive glue 46 is placed closer to fold 34 and further from edge 41 than fugitive glue 40. Most preferably, fugitive glue 46 is placed ¼ to ½ inch further from edge 41 than fugitive glue 40. The preferred fugitive glue is water-based fugitive glue. One such fugitive glue is sold under the designation Craigbond #3991 PLV by Craig Adhesives & Coatings Co.

Figure 4:
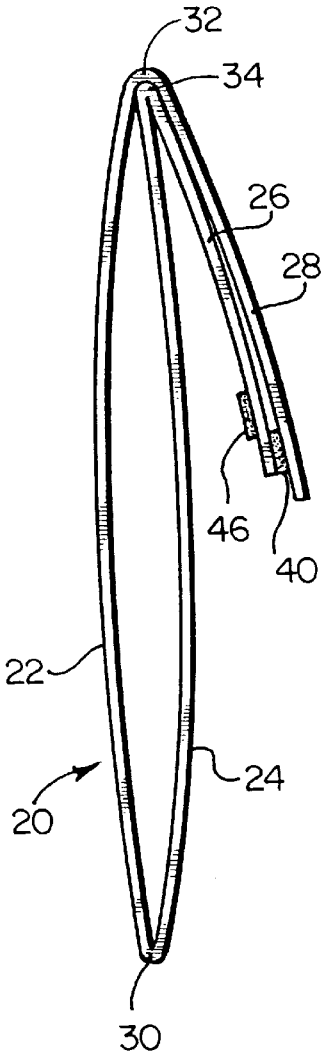
FIG. 4 is a side view of the mailing device shown in FIG. 1 in a partially open configuration.

FIG. 4 shows a side view of mailing device 20 in a partially open configuration representing a first step in gaining access to the mailing device. As shown in FIG. 4, the fugitive glue seal provided by fugitive glue 46 is broken, releasing interior flap 26 from back panel 24. A popping sensation may be sensed by the user upon breaking the fugitive glue seal, attracting the attention of the user and building anticipation.

Mailing device 20 is illustrated with the end of exterior flap 28 extending slightly beyond the end of interior flap 26. As alternatives, the ends of the exterior flap 28 and interior flap 26 may terminate at the same point or the end of interior flap 26 may be arranged to extend beyond the end of exterior flap 28. These various arrangements may assist the user in completing the first step.

Figure 5:
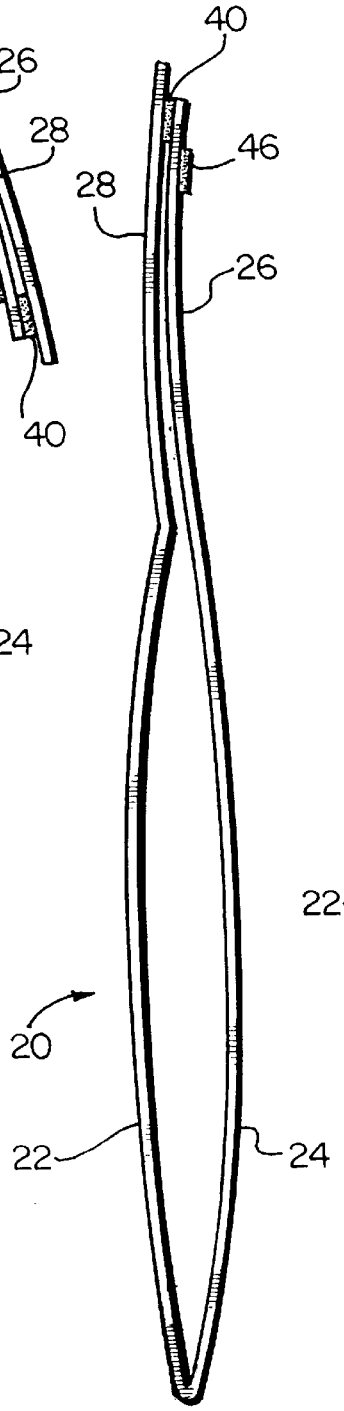
FIG. 5 is another side view of the mailing device shown.

FIG. 5 shows another side view of mailing device 20 in a partially open configuration representing a second step in gaining access to the mailing device. As shown in FIG. 5, interior flap 26 and exterior flap 28, which are still in sealing engagement, are shown articulated to be substantially parallel to front panel 22 and back panel 24. In this arrangement, a first promotional message, which was previously concealed on inner surface 42 of interior flap 26, is made available to the user. However, the interior of device 20 is not available due to the seal provided by fugitive glue 40. In addition to a promotional message, instructions may be placed on the inner surface 42 of interior flap 26 directing the user to break the seal between interior flap 26 and exterior flap 28.

Figure 6:
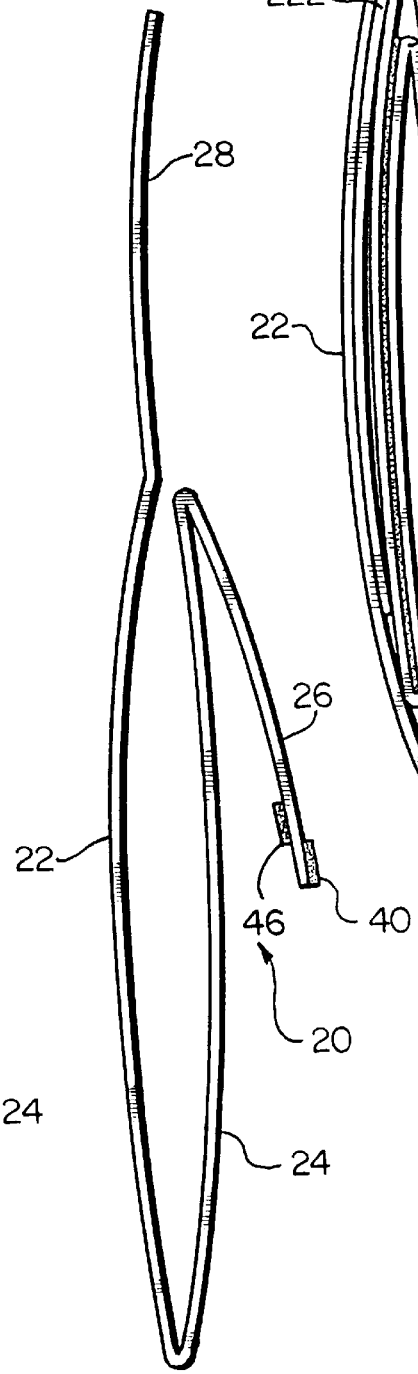
FIG. 6 is a side view of the mailing device shown in FIG. 1 in an open configuration.

FIG. 6 shows a side view of mailing device 20 in an open configuration, resulting from a further step of breaking the fugitive glue seal provided by fugitive glue 40. This further step allows access to the interior of the mailing device and an additional popping sensation. In this arrangement, a second promotional message, which was previously concealed on inner surface 50 of exterior flap 28, is made available to the user. Additionally, a message may be revealed on outer surface 38 of interior flap 26.

In a preferred embodiment, an advertisement device in accordance with the principles of the present invention in the form of a mailing device will also include an enclosure as illustrated in FIGS. 7 through 11. The enclosure may carry valuable information for a consumer and preferably may include a business reply envelope and an order form.

Figure 7:
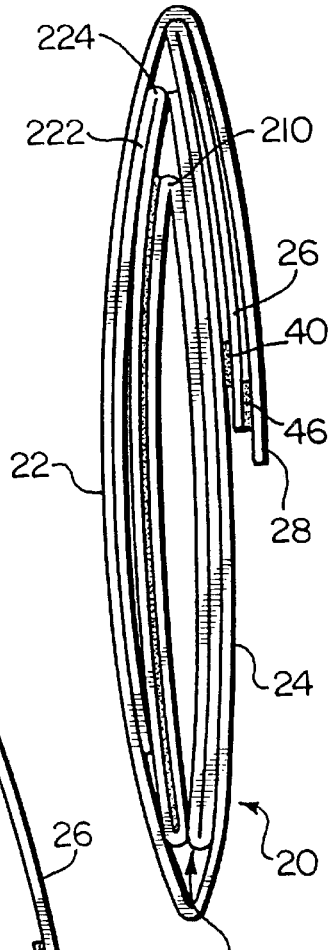
FIG. 7 is an embodiment of a mailing device in accordance with the present invention including an enclosure.

FIG. 7 shows a side view of mailing device 20 with an enclosure 200 retained within the device. Enclosure 200 is preferably one contiguous form or sheet with a plurality of panels, one or more of which may be formed into an envelope. Enclosure 200 may simply rest within mailing device 20 between front panel 22 and back panel 24, as shown in FIG. 7, or may be adhesively secured to first fold 30 between front panel 22 and back panel 24, or otherwise adhesively secured.

Figure 9:
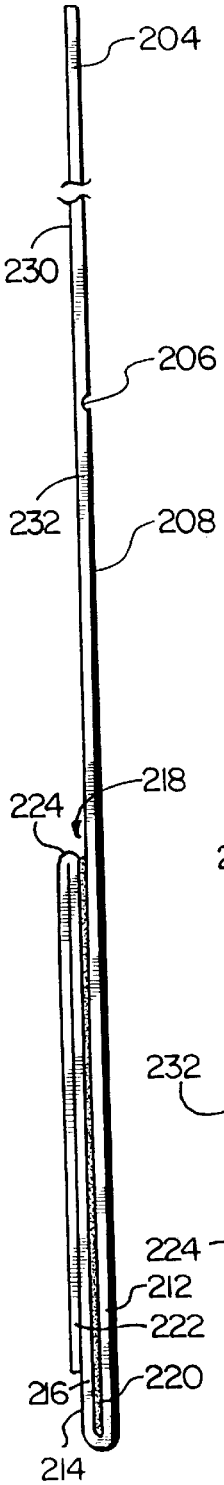
FIG. 9 is a side view of the enclosure shown in FIG. 7.
Figure 8:
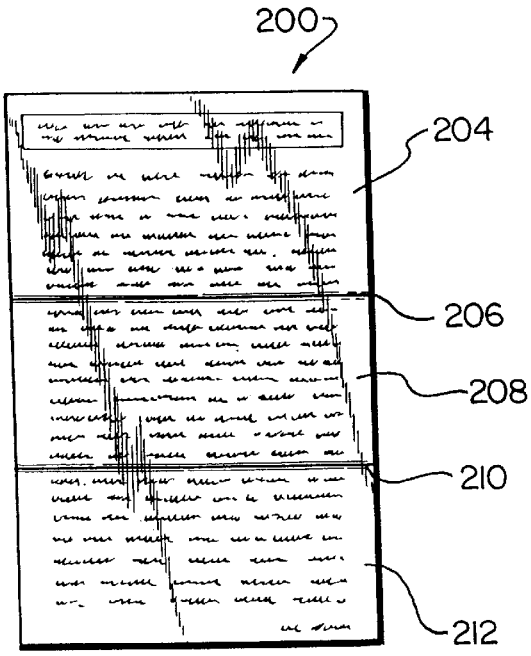
FIG. 8 is a front view of the enclosure shown in FIG. 7.
Figure 10:
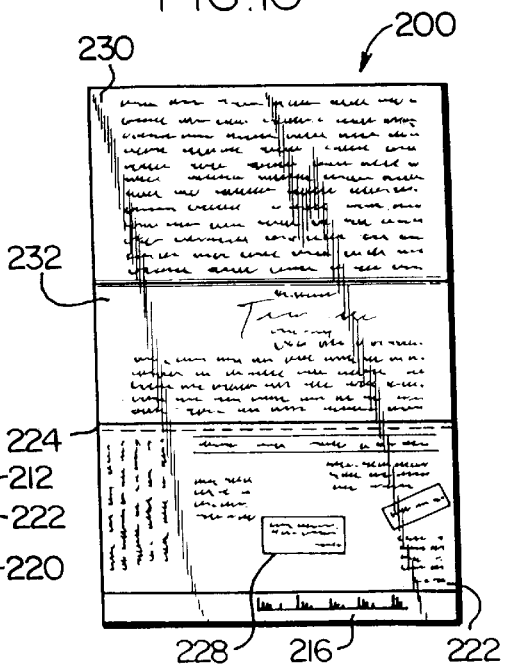
FIG. 10 is a back view of the enclosure shown in FIG. 7.

FIGS. 8, 9 and 10 show respectively, a front view, a side view and a back view of enclosure 200 with its plurality of panels fully articulated to be parallel to each other. When fully articulated or unfolded, the front of enclosure 200 reveals a top panel 204, a middle panel 208 and a bottom panel 212. Top panel 204 and middle panel 208 are adjoined and adjacent, being separated by fold 206. Middle panel 208 and bottom panel 212 are adjacent and adjoined and separated by fold 210, which is also perforated. Top panel 204 preferably includes the greeting to the consumer and is followed by valuable printed matter contiguously to the end of bottom panel 212.

Panels 230 and 232, shown in FIG. 10, are the backs of panels 204 and 208, respectively. Panels 230 and 232 may continue the message to the consumer preferably ending at panel 232. Panel 222 is an order form for the consumer to return a reply to the advertiser. Preferably, panel 222 is easily detached from enclosure 200 by perforations along fold 224. As best seen in FIG. 10, panel 222 has an addressee portion 228, which preferably aligns with die-cut window 32 in mailing device 20, as shown in FIGS. 1–5. A distinct advantage of the present invention is the alignment of the addressee portion 228 with the die-cut window of sendee address portion 36, allowing imaging of the address information. Additionally, since the sendee's address is imaged on the order form, the consumer need not rewrite it when ordering. The reuse of the sendee's address reduces the possibility of mistake or omission because only one address is used for both sending and a subsequent reply.

Figure 11:
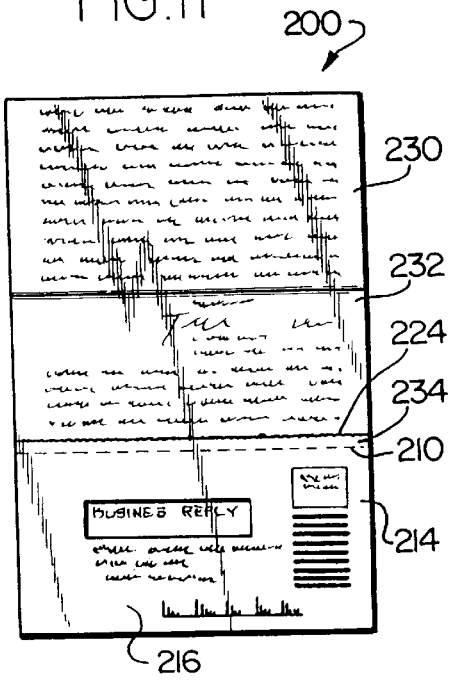
FIG. 11 is a back view of the enclosure shown in FIG. 7 with a slight modification to the enclosure.

FIG. 11 is a back view of enclosure 200 similar to FIG. 10, except that the order form, panel 222, has been removed, revealing the front of an envelope 214. Panel 212, shown in FIG. 8, is the back of envelope 214. The front address portion of envelope 214 is formed by panel 216. Panel 212 and panel 216 are adhesively secured together around two of their edges by permanent glue 220 (FIG. 9), leaving an opening 218 for accessing the content of envelope 214.

Envelope 214 may preferably be detached from enclosure 200 by the perforations along fold 210. A flap 234 for closing envelope 214 is found intermediate panel 216 and the perforations along fold 224. Preferably flap 234 has a water-based remoistenable adhesive that may be activated by the consumer by applying moisture, such as the type of adhesive commonly used on conventional envelopes. One such water-based remoistenable adhesive is sold under the designation Craigbond #3198A by Craig Adhesives & Coatings Co.

Where no order form is necessary, enclosure 200 may be formed without panel 222, as is reflected in FIG. 11. In this alternative embodiment, enclosure 200 is preferably placed within mailing device 20 such that panel 204 is adjacent front panel 22 and sendee address portion 36 is aligned with the sendee's address as printed on panel 204.

Mailing device 20, shown in FIGS. 1–7, may be adapted to be a magazine insert. For example, fold 30 or fold 32 may be bound into a magazine spine. A line of perforations running adjacent and parallel to folds 30 or 32 may be provided to make device 20 detachable.

FIGS. 12A–H illustrate a method by which an advertising device in the form of a mailing device or magazine insert may be constructed in accordance with the principles of the present invention. In particular, FIGS. 12A–H illustrate a method by which device 20, including enclosure 200, as shown in FIGS. 7–11, may be constructed. While a wide variety of finishing equipment may be used to produce the advertising devices, the preferred equipment consists of an appropriate number of plowfolding stations, multiple glue application systems, die cutter, a rotary cutter and a delivery system.

Figure 12A:
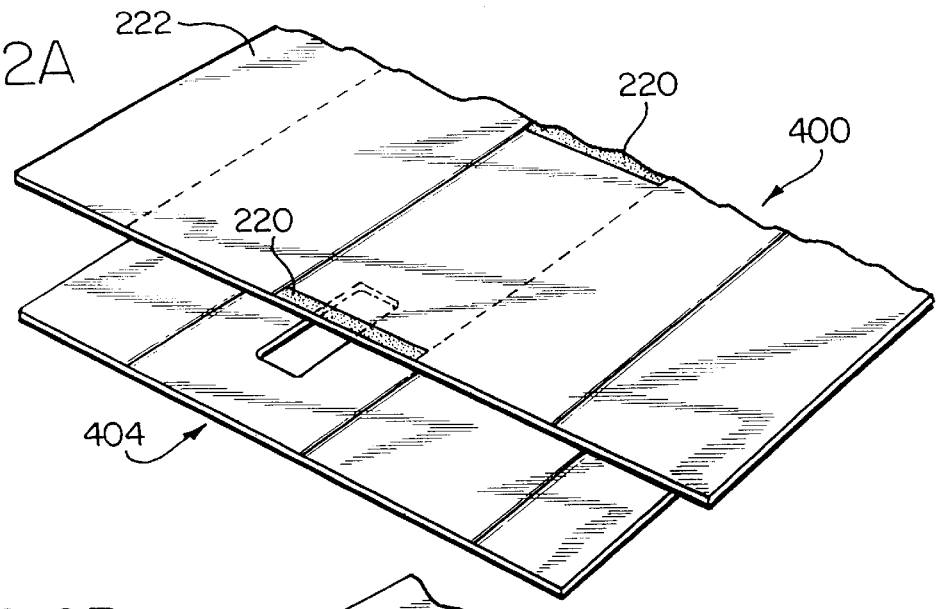
FIGS. 12A–H are perspective views illustrating a method of producing an advertising device in accordance with the principles of the present invention.

FIG. 12A shows two separate ribbons, top ribbon 400 and bottom ribbon 404, vertically aligned with each other. Preferably, top ribbon 400 and bottom ribbon 404 are initially a part of a single web of paper that is cut to form the two ribbons prior to the ribbons being vertically aligned. However, ribbons 400 and 404 may be considered separate webs. The ribbons are printed and contain any necessary perforations or remoistenable adhesives, such as the remoistenable adhesive for a reply envelope. Top ribbon 400 will eventually form enclosure 200. Bottom ribbon 404 will wrap around top ribbon 400 forming the front panel 22, back panel 24, interior flap 26 and exterior flap 28 of mailing device 20.

Figure 12B:
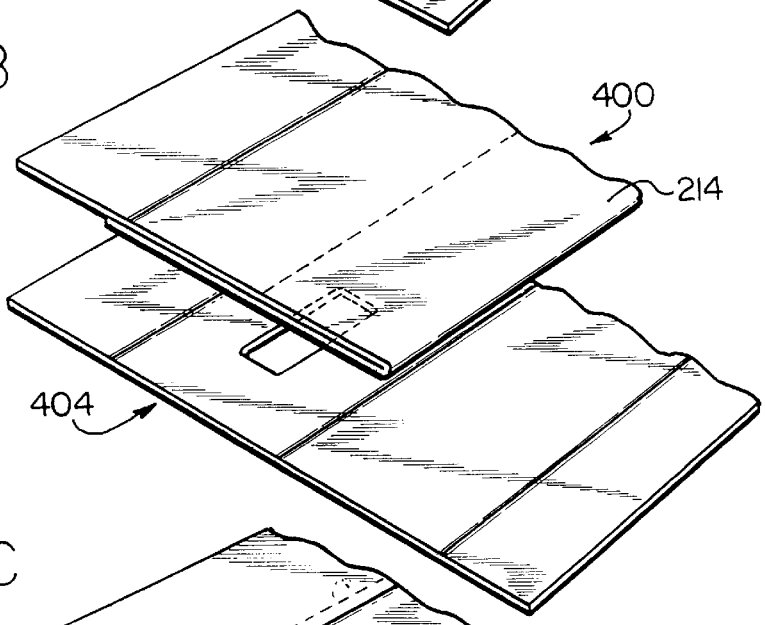
Figure 12C:
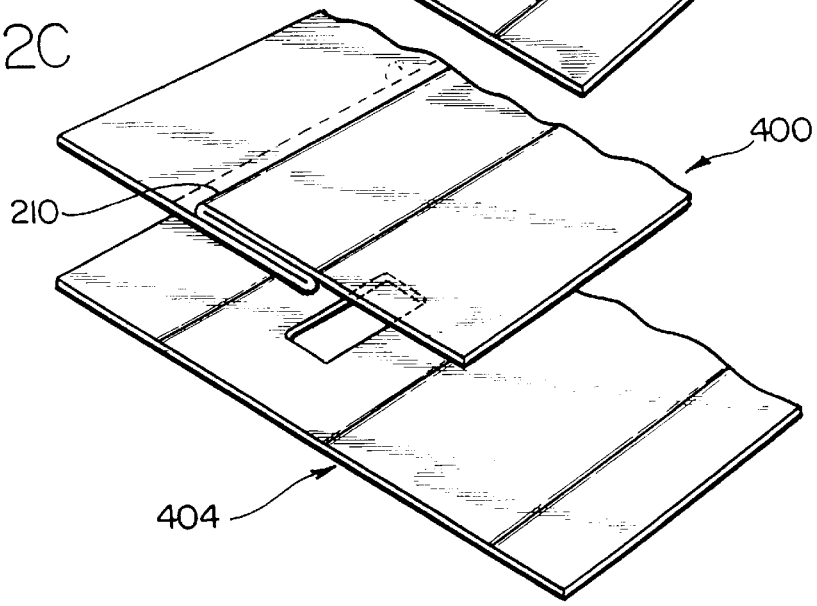
Figure 12D:
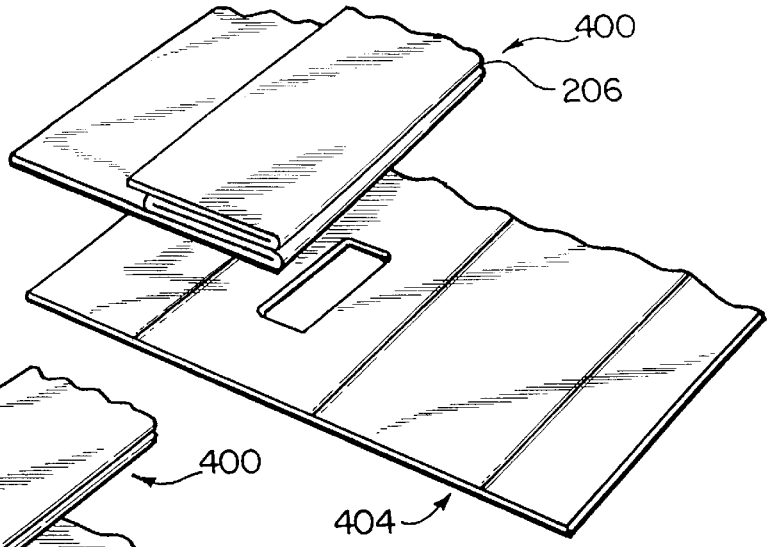
Figure 12E:
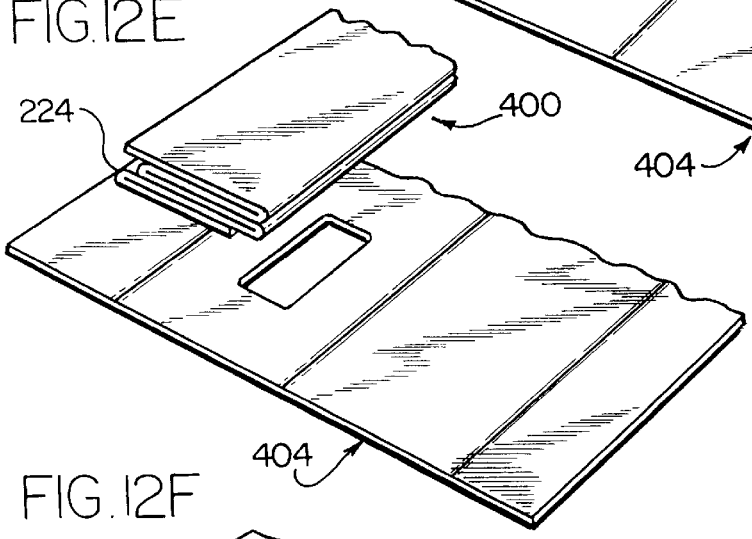

Preferably, enclosure 200 is first formed by multistep folding top ribbon 400 as shown in FIGS. 12B–E. As shown in FIGS. 12A–B, adhesive or glue 220 is applied along the desired points of top ribbon 400 for sealing the sides of envelope 214. This adhesive is preferably a permanent, water-based envelope or spine glue. One such envelope glue is sold under the designation WA2907PK by Elekromek Co., Inc. The fold formed in FIG. 12B serves as the bottom of envelope 214. Top ribbon 400 is then folded in an opposite direction as shown in FIG. 12C. The fold produced corresponds to fold 210, which is perforated. Fold 206 and fold 224 are formed in FIGS. 12D and 12E, respectively, completing the formation of enclosure 200.

Figure 12F:
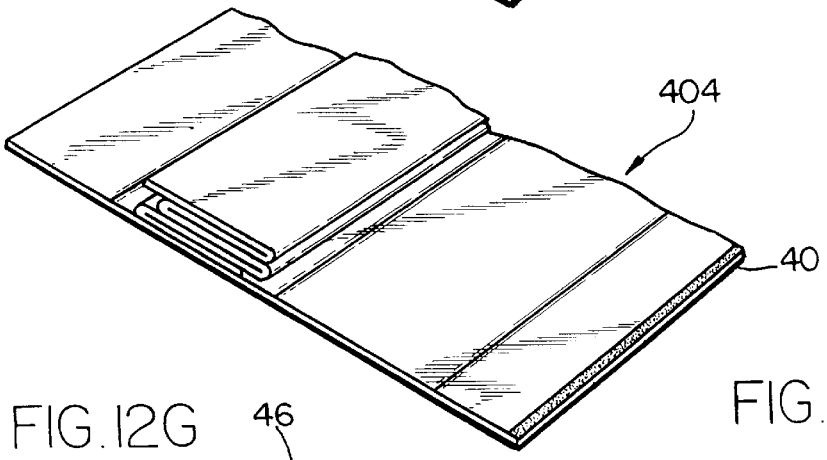
Figure 12G:
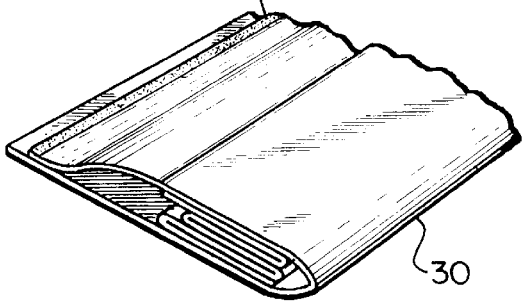
Figure 12H:
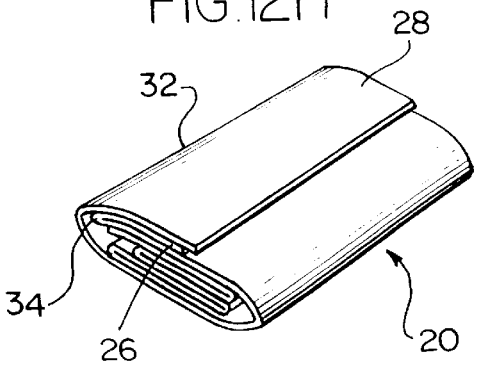

Before bottom ribbon 404 is folded, top ribbon 400, which has been folded into enclosure 200, is aligned to overlay bottom ribbon 404, as shown in FIG. 12F. Adhesive 40 is applied along a first edge of bottom ribbon 404 on its inner surface as shown in FIG. 12F. Fold 30 is then formed as shown in FIG. 12G. Fold 30 allows adhesive 40 to secure a portion of the inner surface of bottom ribbon 404 near a second edge of bottom ribbon 404 that is opposite the first edge. Then adhesive 46 is applied along a portion of the outer surface of bottom ribbon 404 which will be folded to form interior flap 26. Folds 34 and 32 are formed simultaneously as shown in FIG. 12H to create the interior and exterior flaps of the device and secure, via adhesive 46, the combination of the interior and exterior flaps to a portion of the outer surface of bottom ribbon 404, forming the back of device 20. Alternatively, adhesives 40 and 46 may be applied in areas where the interior flap will be secured prior to completing folds 30, 32 and 34. The webs may then be cut to size as illustrated in FIG. 12H.

Alternative embodiments of the above-described method may be produced by altering or eliminating enclosure 200. Additionally, mailing device 20, as shown in FIG. 6 without enclosure 200, may be produced by completing the folding and adhesion steps in FIGS. 17F–l, of course without enclosure 200.

Whereas the present invention has been described with respect to specific embodiments thereof, it will be understood that various changes and modifications will be suggested to one skilled in the art and it is intended that the invention encompass such changes and modifications as fall within the scope of the appended claims.

What is claimed is:

1. A method of producing an advertisement device comprising the steps of:

conveying a first ribbon along a first path, said first ribbon having an inner surface, an outer surface, a first edge and a second edge, said second edge being opposite said first edge;

applying a first adhesive along a first portion of the inner surface of said first ribbon near said first edge of said first ribbon;

folding said first ribbon such that said first adhesive releasably secures said first portion of said inner surface to a second portion of said inner surface near said second edge of said first ribbon to form a folded first ribbon;

applying a second adhesive along a first portion of said outer surface of said first ribbon near said first edge; and folding said folded first ribbon such that said second adhesive releasably secures said first portion of said outer surface near said first edge to a second portion of said outer surface of said first ribbon.

2. The method of claim 1 further comprising the steps of:

conveying a second ribbon along a second path;

folding the second ribbon into an enclosure and;

aligning the enclosure adjacent the inner surface of the first ribbon prior to folding the first ribbon to form said folded first ribbon.

3. The method of claim 2 wherein said first ribbon is vertically aligned with said second ribbon prior to folding.

4. The method of claim 1 wherein the first adhesive is a water-based fugitive glue.

5. The method of claim 1 wherein the second adhesive is a water-based fugitive glue.

6. The method of claim 1 wherein said second adhesive is applied to said outer surface so that relative to said first adhesive, said second adhesive is farther from said first edge.

7. The method of claim 6 wherein relative to said first adhesive, said second adhesive is applied so that said second adhesive is in the range of from about ¼ to ½ inch farther from said first edge.

8. The method of claim 6 wherein in said first folding step, said first ribbon is folded so that said opposite edges are in substantial horizontal alignment.

9. The method of claim 6 wherein relative to said first adhesive, said second adhesive is applied so that said second adhesive is in the range of from about ¼ to ½ inch farther from said first edge.

10. A method of producing an advertisement device comprising the steps of:

(a) conveying a first ribbon along a first path, said first ribbon having an inner surface, an outer surface, a first edge and a second edge, said second edge being opposite said first edge;

(b) applying a first adhesive to said inner surface of said first ribbon near said first edge;

(c) applying a second adhesive to said outer surface of said first ribbon near said first edge;

(d) folding said first ribbon to form a first fold that is substantially in horizontal alignment with said first adhesive and such that said first adhesive releasably secures said inner surface near said first edge to a portion of said inner surface near said second edge of said first ribbon to form a once-folded first ribbon; and (e) folding said once-folded first ribbon to form a second fold and a third fold, said second fold being a defined distance from said first edge and said third fold being a defined distance from said second edge, said second adhesive releasably securing said outer surface near said first edge to another portion of said outer surface, step (e) being the last step to be performed.

11. The method of claim 10 wherein said second adhesive is applied to said outer surface so that relative to said first adhesive, said second adhesive is farther from said first edge.

12. The method of claim 10 wherein in said first folding step, said first ribbon is folded so that said opposite edges are in substantial horizontal alignment.

13. The method of claim 10 wherein said second and said third folds are formed in substantial correspondence with each other.

14. The method of clam 10 wherein all folds are in substantial horizontal alignment.

15. The method of claim 10 further comprising the steps of:

conveying a second ribbon along a second path;

folding said second ribbon into an enclosure; and aligning said enclosure adjacent said inner surface of said first ribbon prior to folding said first ribbon to form said once-folded first ribbon.

16. The method of claim 15 wherein said first ribbon is vertically aligned with said second ribbon prior to folding.

17. The method of claim 10 wherein said first adhesive is a water-based fugitive glue.

18. The method of claim 10 wherein said second adhesive is a water-based fugitive glue.

19. A method of producing an advertisement device comprising:

conveying a first ribbon along a first path, said first ribbon having an inner surface, an outer surface, and two opposite edges;

applying a first adhesive to said inner surface near one of said opposite edges;

applying a second adhesive to said outer surface near one of said opposite edges;

folding said first ribbon so said two opposite edges are adjacent each other and said first adhesive releasably secures said inner surface near one of said opposite edges to said inner surface near the other of said opposite edges; and folding said first ribbon so that said second adhesive releasably secures said outer surface on which said second adhesive is applied to another portion of said outer surface.

20. The method of claim 19 wherein said second adhesive is applied to said outer surface so that relative to said first adhesive, said second adhesive is farther from said first edge.

21. The method of claim 19 wherein relative to said first adhesive, said second adhesive is applied so that said second adhesive is in the range of from about ¼ to ½ inch farther from said first edge.

22. The method of claim 19 wherein in said first folding step, said first ribbon is folded so that said opposite edges are in substantial horizontal alignment.

23. The method of claim 19 wherein said second fold and said third fold are formed in substantial correspondence with each other.

24. The method of claim 19 further comprising the steps of:

conveying a second ribbon along a second path;

folding said second ribbon into an enclosure; and aligning said enclosure adjacent said inner surface of said first ribbon prior to folding said first ribbon to form said once-folded first ribbon.

25. The method of claim 24 wherein said first ribbon is vertically aligned with said second ribbon prior to folding.

26. The method of claim 19 wherein said first adhesive is a water-based fugitive glue.

27. The method of claim 19 wherein said second adhesive is a water-based fugitive glue.

28. A method of making a mailing device comprising:

conveying a first ribbon along a first path, said first ribbon having an inner surface, an outer surface, and two opposite edges;

applying a first adhesive to said inner surface near one of said opposite edges;

folding said first ribbon to form a first fold so that said opposite edges are adjacent each other and said first adhesive releasably secures said first edge to said second edge, said first fold defining a point of intersection between a front panel and a back panel;

applying a second adhesive to said outer surface near one of said opposite edges adjacent said back panel; and folding said folded first ribbon to form a second fold and a third fold, said second and third folds being in substantial horizontal alignment with said first fold, said second fold defining a point of intersection between said front panel and an exterior flap, said third fold defining a point of intersection between said back panel and an interior flap, such that said second adhesive is disposed on said interior flap and releasably secures said interior flap to said outer surface of the mailing device, said second folding step being the last step to be performed.

29. The method of claim 28 wherein said second adhesive is applied to said outer surface so that relative to said first adhesive, said second adhesive is farther from said first edge.

30. The method of claim 28 wherein relative to said first adhesive, said second adhesive is in the range of from about ¼ to ½ inch farther from said first edge.

31. The method of claim 28 wherein in said first folding step, said first ribbon is folded so that said opposite edges are in substantial horizontal alignment.

32. The method of claim 28 wherein said second and said third folds formed in the second folding step that are in substantial correspondence.

33. The method of claim 28 further comprising the steps of:

conveying a second ribbon along a second path;

folding said second ribbon into an enclosure; and aligning said enclosure adjacent said inner surface of said first ribbon prior to folding said first ribbon to form said once-folded first ribbon.

34. The method of claim 33 wherein said first ribbon is vertically aligned with said second ribbon prior to folding.

35. The method of claim 28 wherein said first adhesive is a water-based fugitive glue.

36. The method of claim 28 wherein said second adhesive is a water-based fugitive glue.

* * * * *

UNITED STATES PATENT AND TRADEMARK OFFICE

CERTIFICATE OF CORRECTION

PATENT NO. : 6,080,094
DATED : June 27, 2000
INVENTOR(S) : Ake L. Dahlquist

It is certified that error appears in the above-identified patent and that said Letters Patent is hereby corrected as shown below:

ABSTRACT,
Last line, delete "insert or a stand-along circular."

Column 3,
Line 61, delete "42" and insert therefor -- 38 --.
Line 65, delete "42" and insert therefor -- 38 --.

Column 4,
Line 9, delete "38" and insert therefor -- 42 --.
Line 45, delete "32" and insert therefor -- 36 --.

Signed and Sealed this

Eighteenth Day of December, 2001

*Attest:*

*Attesting Officer*

JAMES E. ROGAN
*Director of the United States Patent and Trademark Office*